US005628396A

United States Patent [19]

Weiner

[11] Patent Number: 5,628,396

[45] Date of Patent: May 13, 1997

[54] FOLDABLE COMBINED RECEPTACLE AND ADVERTISEMENT DISPLAY

[75] Inventor: Douglas S. Weiner, Twinsburg, Ohio

[73] Assignee: Pyram-Ad Corporation, Twinsburg, Ohio

[21] Appl. No.: 401,415

[22] Filed: Mar. 9, 1995

[51] Int. Cl.[6] ..... B65D 5/00

[52] U.S. Cl. ..... 206/216; 206/232; 220/910; 229/116

[58] Field of Search ..... 220/910, 908; 229/115, 116; 206/216, 577, 232

[56] References Cited

U.S. PATENT DOCUMENTS 490,680 1/1893 Roberts ..... 229/116

3,359,657 12/1967 Hedberg ..... 229/116 X 4,237,097 12/1980 McDuffie ..... 229/116 X 4,798,747 1/1989 Laramee ..... 229/116 X

FOREIGN PATENT DOCUMENTS 355396 8/1961 Switzerland .

*Primary Examiner*—Jacob K. Ackun

*Attorney, Agent, or Firm*—Calfee Halter & Griswold

[57] ABSTRACT

A combined waste receptacle and advertising display is formed in a pyramidal shape from a single piece of folded material which to provide an enclosed waste receiving cavity and a three display surfaces. Openings in the pyramid walls provide access to a substantially enclosed waste receiving cavity. Advertising information and/or articles may be applied or attached to the remaining surface area of the walls.

3 Claims, 4 Drawing Sheets

FOLDABLE COMBINED RECEPTACLE AND ADVERTISEMENT DISPLAY

FIELD OF THE INVENTION

The present invention pertains generally to foldable structures and, in particular, to foldable three dimensional structures.

BACKGROUND OF THE INVENTION

With the elimination of ashtrays from a large percentage of restaurant table tops, there is a newly created need for a receptacle for such things as chewing gum, sugar packets and straw wrappers. For chewing gum in particular, the inadequacy of ashtrays as a receptacle is illustrated by the presence of gum stuck to the underside of restaurant tables everywhere. Ideally, such a receptacle would be aesthetically pleasing, have a substantially enclosed waste cavity, and occupy no more space than an ashtray.

Foldable articles made of paper board or other foldable material are used as advertising displays for table tops in restaurants. Such articles are typically folded to have a base and two display surfaces upon which an advertisement is printed. For example, the common "tent" table top display is formed of a single piece of card stock folded in 2half with the end of each half folded inward to form an interlocking base. The tent thus provides two generally vertically oriented display panels which carry a printed advertisement. Though three dimensional, such tents have only two display surfaces and do not serve as waste receptacles.

SUMMARY OF THE INVENTION

The present invention provides a novel solution to the problem of restaurant table top waste management in combination with a novel table top advertisement format.

In accordance with one aspect of the invention, a combined receptacle and advertisement display is formed from a single sheet of foldable material having three fold lines which define adjoining edges of four generally rectangular interconnected panels including a central panel, a right panel connected along a first fold line to the central panel, a left panel connected along a second fold line to the central panel, and a bottom panel connected along a third fold line to the central panel; the right, left and bottom panels being foldable along respective fold lines relative to the central panel to form a three dimensional structure having a receptacle cavity and three advertising display surfaces.

In accordance with another aspect of the invention, a pyramidal table top advertisement display and waste receptacle is formed from a single sheet of foldable material to provide a substantially enclosed waste receptacle accessible through an aperture in at least one of the pyramid walls which bear advertising indicia.

These and other aspects of the present invention are herein fully disclosed in the following Detailed Description made with the reference to the annexed Figures.

DETAILED DESCRIPTION OF A PREFERRED EMBODIMENT

Figure 1:
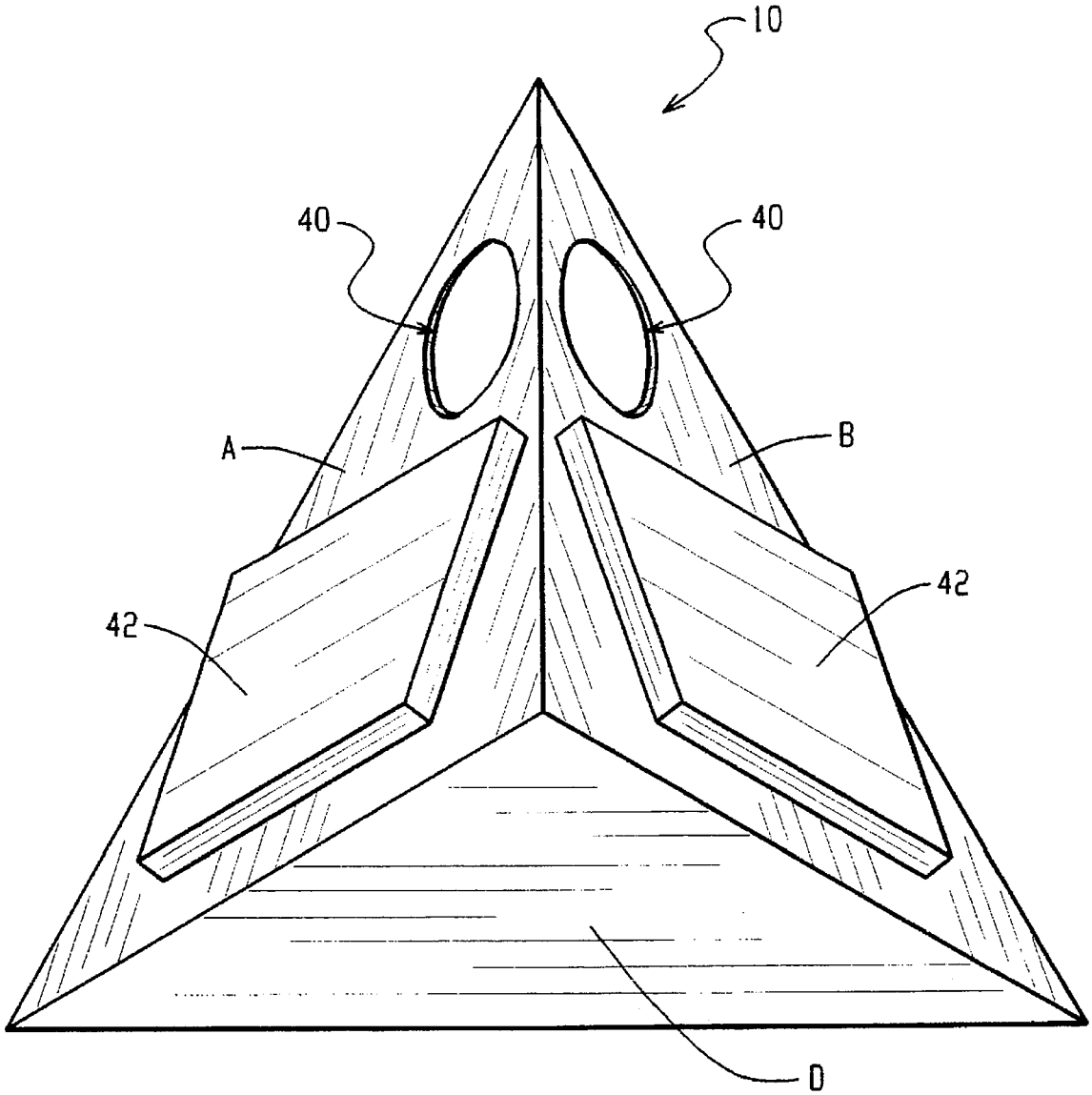
FIG. 1 is a perspective view of the Combined Receptacle and Advertisement Display of the present invention.
Figure 4:
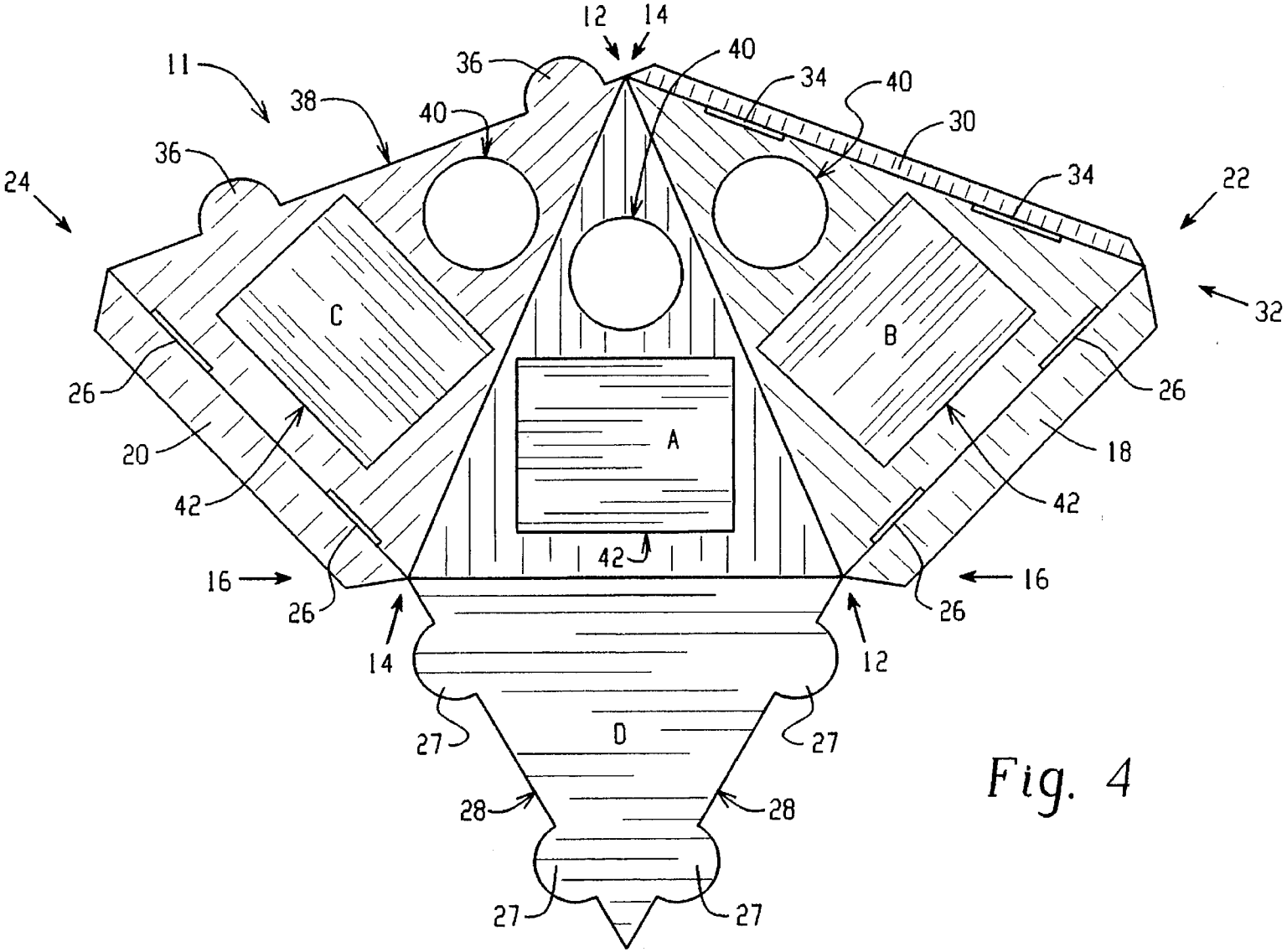
FIG. 4 is a plan view of the single sheet from which the Combined Receptacle and Advertisement Display of the present invention is formed.

FIG. 1 illustrates a preferred embodiment of the combined receptacle and advertising display 10 of the present invention in an assembled configuration which novelly provides a generally concealed waste receptacle and three distinct display panels or walls. The display 10 is formed from a single sheet 11 of card stock or any other suitable foldable material cut substantially in the unfolded configuration shown in FIG. 4 to include a central panel A, a right panel B, a left panel C and a bottom panel D. The four panels are interconnected along adjoining edges by respective fold lines 12, 14 and 16. In this particular embodiment, the length of fold lines 12 and 14 is substantially greater than fold line 16 in order to increase the volume of the waste receiving cavity without increasing the surface area of bottom panel D. Panels B and C further include foldable bottom flaps 18 and 20, respectively, attached to a bottom edge of the panel along respective fold lines 22 and 24. Locking tab insertion slots 26 are provided adjacent fold lines 22 and 24 to receive and engage locking tabs 27 which extend from peripheral edges 28 of panel D, in the manner well known in the foldable structure arts. Panel B further includes a foldable peripheral flap 30 attached to a peripheral edge of panel B along fold line 32. Locking tab insertion slots 34 are positioned adjacent fold line 32 to receive and engage locking tabs 36 which extend from peripheral edge 38 of panel C.

Figure 2:
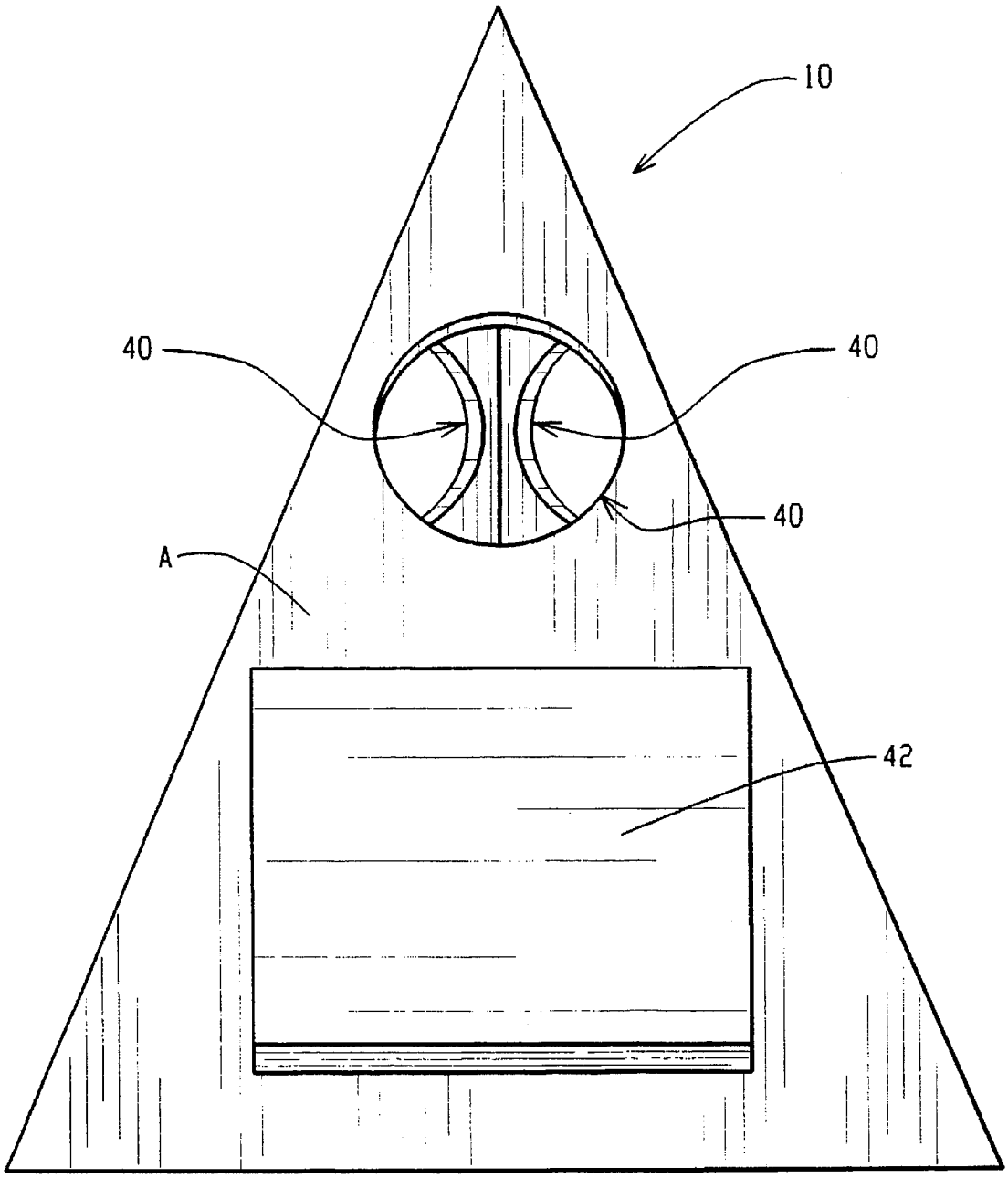
FIG. 2 is a side elevation of the Combined Receptacle and Advertisement Display of the present invention.
Figure 3:
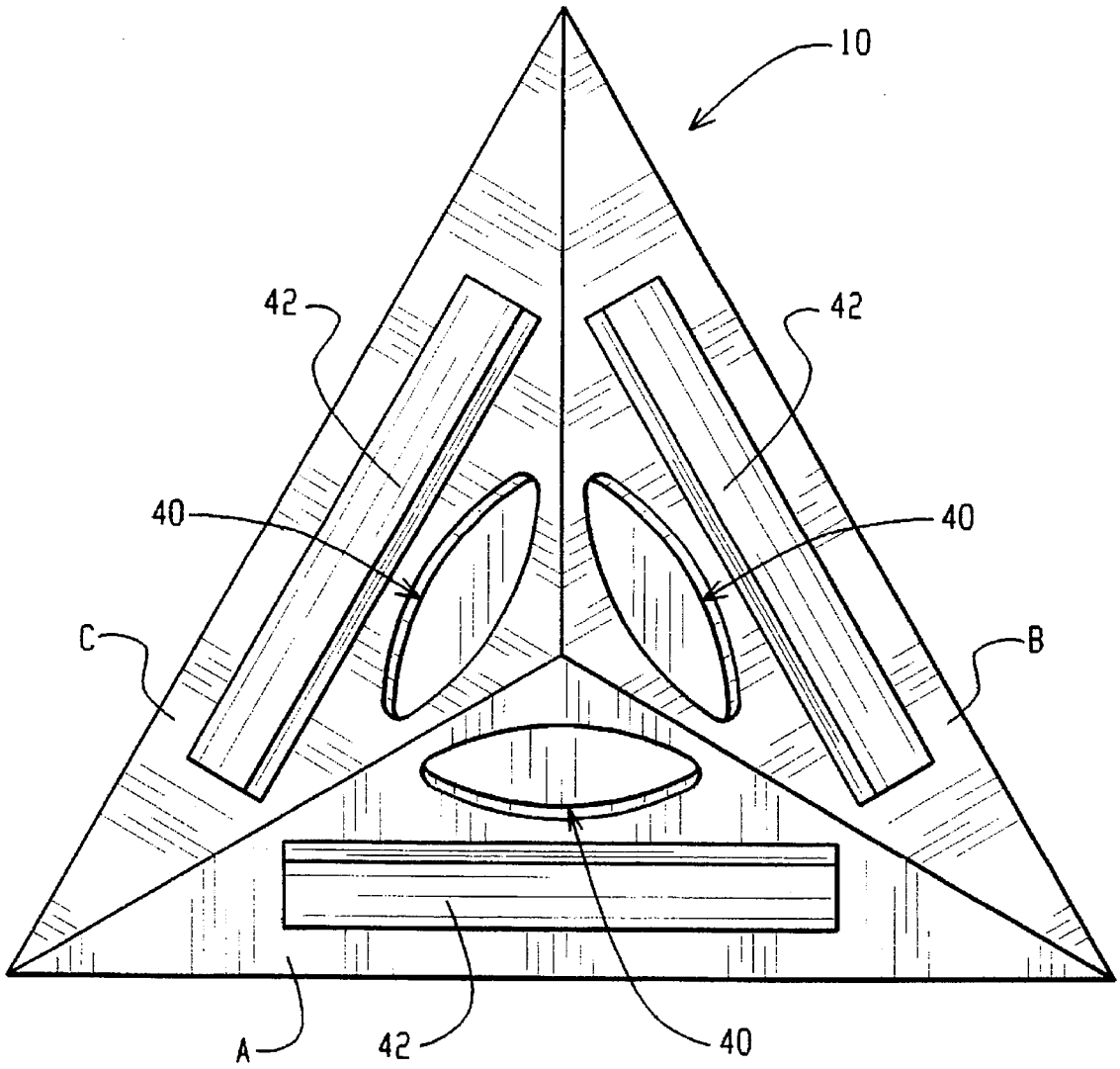
FIG. 3 is a top view of the Combined Receptacle and Advertisement Display of the present invention.

To transform the display 10 into the three dimensional pyramidal folded configuration shown in FIGS. 1–3, peripheral flap 30 of panel B is first folded relative to panel B away from the exterior face of panel B. Panels B and C are then each folded relative to panel A, away from the exterior face of panel A, along fold lines 12 and 14 each to the extent that peripheral edge 38 meets fold line 32 with peripheral flap 30 tucked underneath panel C. Locking tabs 36 are inserted into slots 34. Bottom flaps 18 and 20 are then folded inward and panel D is also folded away from the face of panel A, to overlap bottom flaps 18 and 20 and position locking tabs 27 for insertion into slots 26. Apertures 40 may be selectively placed and shaped in panels A, B and C to provide access to the substantially enclosed waste receiving cavity formed by the described structure. The receptacle can be easily emptied by disengaging locking tabs 26 and opening panel D by hinged rotation along fold line 16. Furthermore, multiple assembled displays may be vertically stacked by similarly opening (or folding inward) bottom panel D to allow insertion of the point of another display.

The remaining exterior surface area of each panel is sufficient for attachment of an additional article or articles, which may be, for example, an advertising medium such as adhesively attached pieces of paper in the form of a miniature tablet 42 upon which messages may be printed and which may also be used to wrap waste material such as chewing gum prior to placing it in the receptacle. Other articles may be attached to the walls of the pyramid to attract attention to the advertisement display.

The invention thus provides a three dimensional receptacle and generally vertically oriented advertising display ideally suited for placement upon a table top to receive small waste materials and to carry advertising messages on each of the sides of the display.

Although the invention has been described in detail with reference to one particular embodiment, obvious modifications and variations are all within the basic concept of the invention as defined by the accompanying claims and equivalents thereto.

I claim:

1. A foldable advertising display stand and receptacle in the shape of a pyramid, comprising, a first triangular pyramid wall, a second triangular pyramid wall attached along a fold line to a first edge of the first pyramid wall, a third triangular pyramid wall attached along a fold line to a second edge of the first pyramid wall, and a triangular pyramid base attached along a fold line to a third edge of the first pyramid wall, each of said triangular walls foldable along respective fold lines and relative to an attached wall to form a pyramid, each of said triangular walls and base having three linear edges, edges of walls abutting and not connected by a fold line lockingly engageable in a pyramidal configuration, peripheral flaps which extend from linear edges of the second and third triangular walls, locking tabs which extend from a linear edge of the third triangular wall and from two linear edges of the triangular pyramid base, locking tab insertion slots in the second and third triangular walls adjacent peripheral flaps which extend from linear edges of the second and third triangular walls, the locking tabs dimensioned for insertion into and locking engagement with corresponding locking tab insertion slots in the second and third triangular pyramid walls, an unobstructed opening in at least one of the pyramid walls, the opening having boundaries which are within the linear edges of the wall, and an article attached to at least one of the pyramid walls, the article being in the form of a tablet of adhesively attached papers.

2. The foldable advertising display stand and receptacle of claim 1, wherein the opening in at least one of the triangular walls is generally circular and provides an unobstructed path to an interior of the display stand formed by the attached walls, whereby waste items can be deposited into the interior of the display stand through the opening.

3. The foldable advertising display stand and receptacle of claim 1 wherein the article attached to at least one of the pyramid walls is dimensioned to fit within the linear edges of the wall.

* * * * *